US006550830B2

(12) United States Patent
Kueznel

(10) Patent No.: US 6,550,830 B2
(45) Date of Patent: Apr. 22, 2003

(54) BOLT SEAL

(76) Inventor: Rainer Kueznel, P.O. Box 824, Hunt, TX (US) 78024

( * ) Notice: Subject to any disclaimer, the term of this patent is extended or adjusted under 35 U.S.C. 154(b) by 3 days.

(21) Appl. No.: 09/802,255

(22) Filed: May 9, 2001

(65) Prior Publication Data

US 2002/0074811 A1 Jun. 20, 2002

Related U.S. Application Data

(60) Provisional application No. 60/215,327, filed on Jul. 3, 2000.

(51) Int. Cl.[7] ..... E05B 39/02

(52) U.S. Cl. ..... 292/327; 292/307 R; 292/323; 292/318

(58) Field of Search ..... 292/327, 307 R, 292/315, 316, 317, 318, 319, 320, 321, 323, 325; 24/136 A, 136 R, 115 N, 115 L, 710.3, 582, 581; 411/383, 384, 354, 355

(56) References Cited

U.S. PATENT DOCUMENTS 1,332,291 A * 3/1920 Goodell ..... 292/327
3,345,452 A * 10/1967 Logan et al. ..... 174/71 R
3,945,671 A * 3/1976 Gerlach ..... 292/323
4,010,788 A 3/1977 Van Gompel ..... 151/2 A
4,075,742 A * 2/1978 Remark et al. ..... 24/453
4,141,117 A * 2/1979 Van Gompel ..... 24/136 A
4,183,567 A * 1/1980 Bone ..... 292/318
4,640,538 A * 2/1987 Brammall ..... 292/323
4,681,356 A 7/1987 Brammall ..... 292/327
4,685,317 A * 8/1987 DeWalch ..... 292/307 R
4,991,889 A * 2/1991 Remark ..... 292/327
5,141,355 A * 8/1992 Stillwagon ..... 403/322.2
5,347,689 A 9/1994 Georgopoulos et al. .. 24/136 R
5,364,046 A * 11/1994 Dobbs et al. ..... 244/161
5,542,273 A * 8/1996 Bednarz ..... 29/263
5,556,233 A * 9/1996 Kovago ..... 405/259.4
5,732,989 A * 3/1998 Stevenson et al. ..... 292/318
5,749,610 A 5/1998 Brammall et al. ..... 292/327
5,961,266 A * 10/1999 Tseng ..... 411/383
6,039,365 A * 3/2000 Rogatnev ..... 292/318
6,155,617 A 12/2000 Kuenzel ..... 292/318
6,247,883 B1 * 6/2001 Monserratt ..... 411/34
6,406,074 B1 * 6/2002 Mahaney ..... 292/256.6
6,428,243 B1 * 8/2002 Hutchins ..... 405/259.1

* cited by examiner

*Primary Examiner*—James R. Brittain
*Assistant Examiner*—Thomas Ho
(74) *Attorney, Agent, or Firm*—Browning Bushman P.C.

(57) ABSTRACT

A bolt seal provides a slidable sleeve surrounding a solid bolt body having a bolt head affixed at one end. The sleeve is held in abutting contact with the bolt head at one end of the sleeve and a shoulder comprising an enlarged diameter portion of the solid bolt body at the other end of the sleeve. The bolt head can therefore be pressed snug against a seal housing, thereby eliminating a mode of jimmying the seal, while simultaneously providing a means for opening the seal with bolt cutters when the seal must be opened.

21 Claims, 5 Drawing Sheets

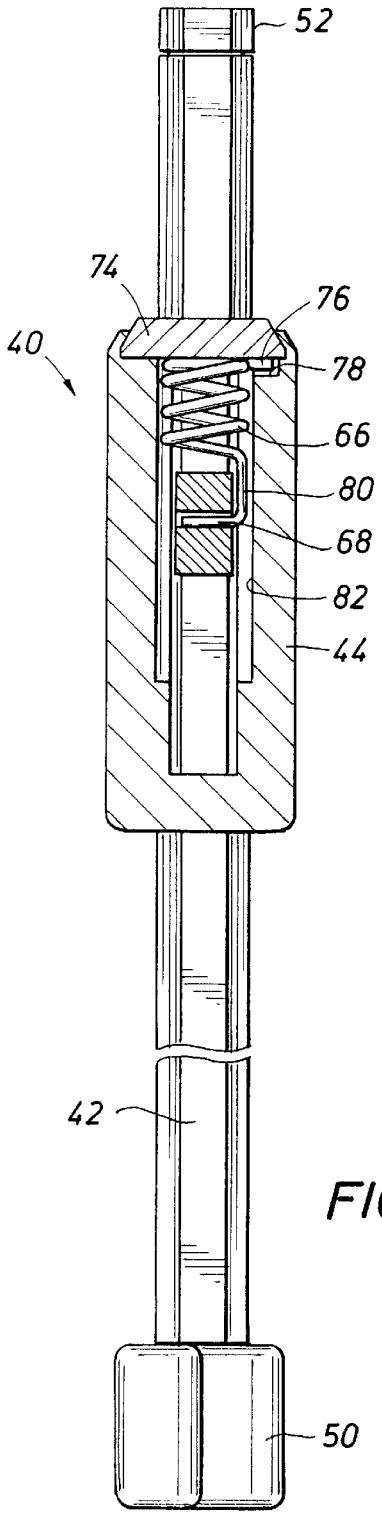
FIG. 4
FIG. 3
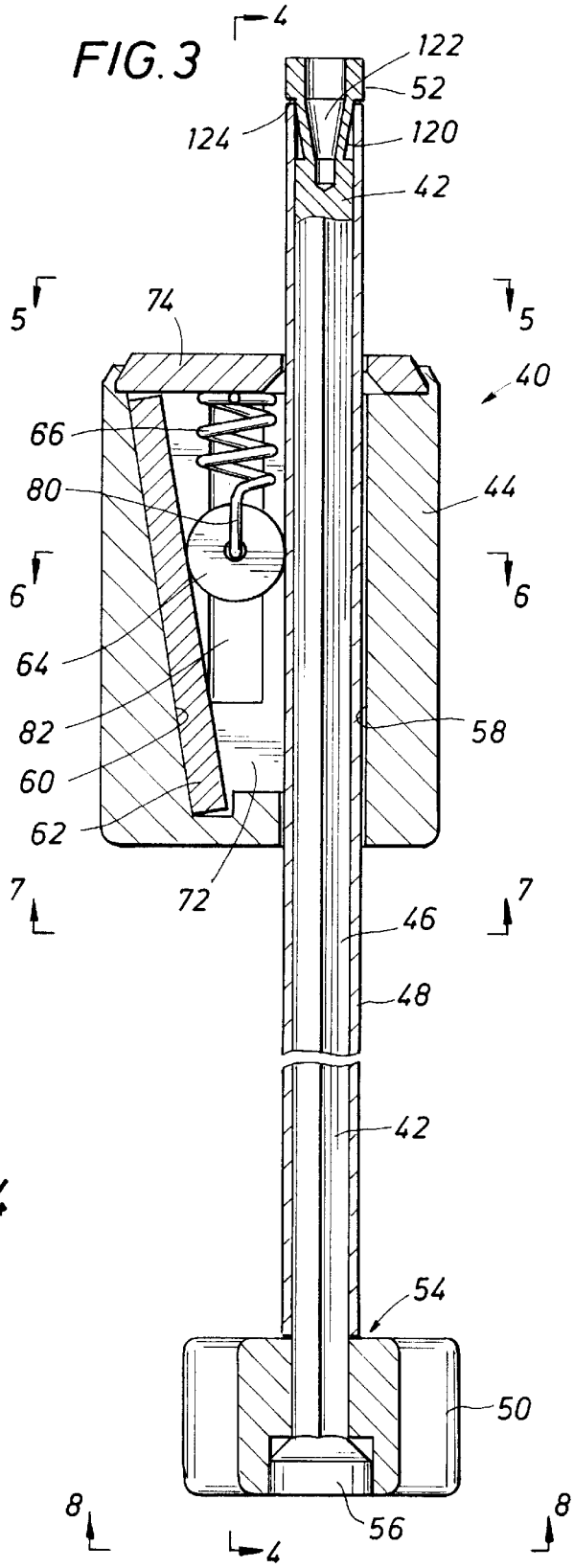

BOLT SEAL

This application claims the benefit of provisional application Ser. No. 60/215,327, filed Jul. 3, 2000.

FIELD OF THE INVENTION

The present invention relates generally to the field of bolts seals and, more particularly, to a sleeved bolt and seal construction which avoids some modes of defeating the seal function without detection.

BACKGROUND OF THE INVENTION

Door closures and locks are often provided with a bolt and seal mechanism to stop intruders from jimmying the lock. Such a closure may comprise a hasp on a cargo door of a truck, for example, or other application. When a such a closure is jimmied, the intruder frequently will try to find a way of opening the closure without leaving evidence of the intrusion. Such mechanisms typically include a body, larger in diameter than the bolt, which attaches to or is integrally formed with the bolt on the end of the bolt opposite the bolt head. The bolt attaches to the interior of the body with a snap ring to provide an enlarged region on either side of the closure hasp to lock the closure. Other bolt seals may include a grip mechanism to prevent retraction of the bolt from the device in the direction opposite its insertion, such as that shown and described in U.S. Pat. No. 4,681,356 directed to cables, but equally adaptable to bolts.

To open the closure, the bolt must be cut with bolt cutters. Consequently, the length of the bolt between the bolt head and the body of the seal means must be longer than the thickness of the hasp in order to provide room for the bolt cutters to access and sever the bolt. And, if there is enough room for bolt cutters to gain access, then there is enough room for a jimmying tool to defeat the mechanism inside the body and thereby open the seal without leaving any evidence of intrusion. The jimmying tool is inserted between the bolt and the hasp and further into the wedge mechanism holding the bolt so that the body slides easily off the bolt, leaving no evidence that the mechanism has been defeated.

Thus, there remains a need for a bolt seal which eliminates the space between the bolt head and the hasp or closure, to prevent tampering with the seal mechanism. Such a bolt seal should be simple and inexpensive to manufacture, yet defeat the previously described modes of opening the closure without leaving evidence that the closure has been opened.

SUMMARY OF THE INVENTION

The present invention addresses these and other needs in the art by providing a bolt seal and lock mechanism equipped with a bolt gripping mechanism that is not easily defeated. The bolt seal provides a slidable sleeve surrounding a solid bolt body having a bolt head affixed at one end. The sleeve is held in abutting contact with the bolt head at one end of the sleeve and a shoulder comprising an enlarged diameter portion of the solid bolt body at the other end of the sleeve. In this first preferred embodiment, the bolt and seal form a polygon in cross-section to prevent rotation. The bolt head can therefore be pressed snug against a seal housing, thereby eliminating a mode of jimmying the seal, while simultaneously providing a means for opening the seal with bolt cutters when the seal must be opened.

The bolt body and sleeve, which make up the bolt, penetrate the housing in one direction, but a jam lock mechanism prevents motion of the bolt in the other direction. The jam lock mechanism includes a roller which rides on a ramp liner and is biased with a spring. The materials of the ramp liner, roller, sleeve, and bolt body are selected of various hardnesses to prevent opening the lock seal under force, as with a crow bar.

In another preferred embodiment of the lock seal, the bolt penetrates a rotatable body within the housing, and the bolt is preferably circular in cross section. The rotatable body includes a pair of jam lock mechanisms to hold the bolt stationary relative to the rotatable body and the housing.

These and other features of the present invention will be apparent to those skilled in the art from a review of the following detailed description along with the accompanying drawings.

BRIEF DESCRIPTION OF THE DRAWINGS

So that the manner in which the above recited features, advantages, and objects of the present invention are attained and can be understood in detail, more particular description of the invention maybe had by reference to the embodiments thereof which are illustrated in the appended drawings. It is to be noted, however, that the appended drawings illustrate only typical embodiments of this invention and are therefore not to be considered limiting of its scope, for the invention may add to other equally effective embodiments.

FIG. 3 is a side section view of the bolt seal of the present invention.

FIG. 4 is a front section view of the bolt seal of the invention.

DETAILED DESCRIPTION OF PREFERRED EMBODIMENTS

Structure of a First Preferred Embodiment of the Invention

Figure 1:
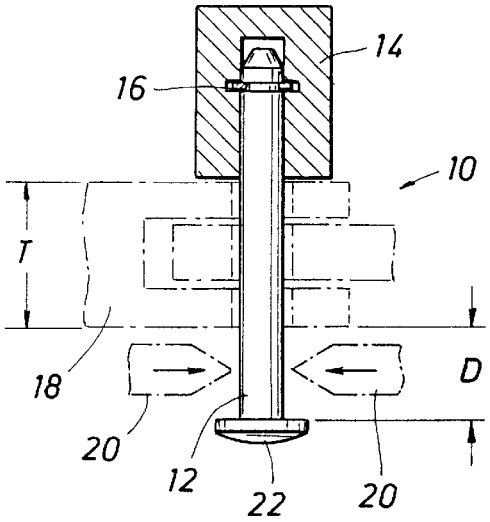
FIG. 1 (PRIOR ART)
FIG. 1 is a side view in partial section of a prior art bolt seal.

FIG. 1 depicts a known bolt lock 10. The bolt lock 10 comprises a bolt 12 of predetermined length and a seal body or housing 14 joined to the bolt 12 with a snap ring 16. The bolt 12 is fitted through a hasp 18, shown in phantom in FIG. 1, which defines a thickness T. Thus, the predetermined length of the bolt leaves a distance D between hasp 18 and a bolt head 22. The distance D is necessary to provide access for the blades 20 of a bolt cutter when the lock 10 must be removed. Unfortunately, the distance D also provides plenty of room for the insertion of a "slim jim" tool, if someone should try to defeat the lock without leaving evidence of such intrusion.

Figure 2:
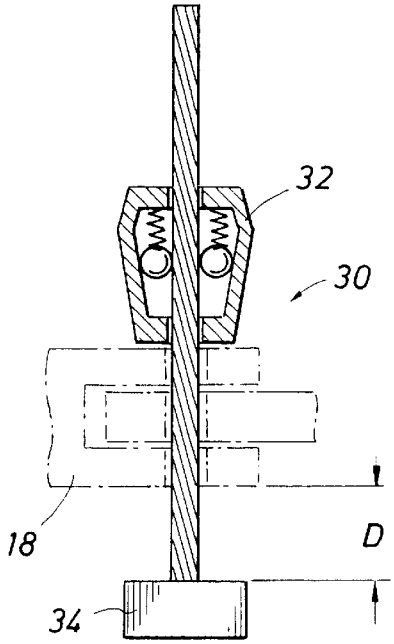
FIG. 2 (PRIOR ART)
FIG. 2 is a side view in partial section of a prior art cable seal.

FIG. 2 depicts a known cable lock 30 which serves the same purpose as the bolt lock 10. In the case of the cable lock 30, the length of exposed cable between a lock housing 32 and a cable head 34 is adjustable according to the total thickness of the door hasp 18. However, ample space D once again must be left for the blades for the bolt cutter (FIG. 1), when the lock must be removed, providing the same opportunity for the insertion of a defeating "slim jim" tool.

FIG. 3 depicts a bolt lock 40 of the present invention which addresses these and other drawbacks in the known locks just described. As shown in FIG. 3, a bolt 42 extends through a lock housing 44. The bolt 42 comprises three principal components, an inner polygonal and preferably hexagonal solid bolt body 46, an outer bolt sleeve 48, and a bolt head 50. The bolt body 46, preferably made of steel, is slidably held inside the sleeve 48, which is preferably made of aluminum. The sleeve is also polygonal and preferably hexagonal and is prevented from sliding off the bolt by a widened head 52 of the bolt outside the lock housing 44. At the other end of the bolt 42, the sleeve 48 and the head 50 are in abutting contact at an abutment 54.

As previously described, the bolt body 46 is hexagonal in cross section, which makes twisting the bolt relative to the housing 44 impossible. This feature is provided because twisting the bolt within the housing is the first thing an intruder would try when attempting to get the bolt out of the housing. The bolt body 46 at its lower end defines a head 56 which connects the bolt body 46 to the head 50, which is preferably made of a soft material such as zinc. The housing 44 is preferably a zinc injection part with a hexagonal passage 58 to receive the bolt.

The housing 44 further includes an angled ramp 60 which is lined with a liner 62. Between the liner 62 and the sleeve 48 is a suspended roller 64 which is urged downward by a spring 66. The roller 64 is preferably made of hardened steel. It is therefore possible to move the bolt 42 upward into the housing 44 but any attempted movement retracting the bolt downward out of the housing jams the disc 64 ever tighter between the liner 62 and the bolt sleeve 48, thus preventing the removal of the bolt from the housing. If an intruder tries to open the lock by force, for example by applying a crow bar, the roller 64 will be forced to bite through the aluminum sleeve 48 and into the steel bolt body 46. Therefore, the roller 64 must be harder than the bolt body 46, or the roller 64 would be deformed by such action before it could make an indentation in the bolt body 46 and the entire bolt would start to slip, eventually all the way out of the housing 44. It is also important that the roller not indent the ramp, which is preferably made of zinc, which is softer than the steel of the roller. Thus, the ramp is lined with the liner 62, which is made of a material which is at least as hard as the roller. If the roller 64 digs into the ramp or the liner, the bolt 42 may slip through the housing under high load, thus defeating the lock.

Figure 6:
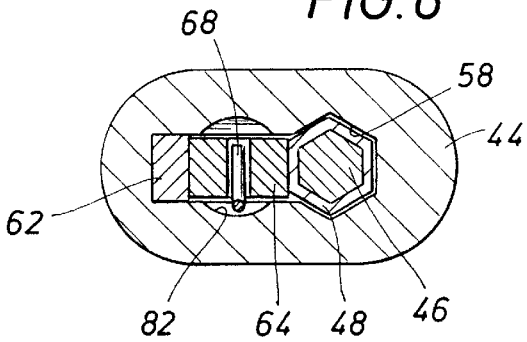
FIG. 6 is a top section view of the bolt seal of the invention taken along view ones 6—6 of FIG. 3.

FIG. 4 provide a side view of the bolt lock 40. The spring 66 extends to a hook 68 which penetrates a central hole 70 in the roller 64. This holds the roller suspended in approximately the middle of a slot 72 formed in the housing 44. Thus, the spring 66 is held in place by a cap 74 which is joined to the housing 44 and forms a portion of the housing. The spring 66 is retained by the cap 74 by an extension 76 which fits into a hole or pocket 78 in the housing. This prevents the roller from falling down to the bottom of the slot 72 and out the passage 58 before the bolt is inserted through the housing. The roller might fall through the passage 58 because the roller is small in diameter relative to the diameter of bolt 42. The spring 66 also includes a vertical arm 80 to extend between the coiled portion of the spring and the hook 68, and the housing thus defines a cavity 82 to accommodate the vertical arm 80. As shown in FIG. 6, the cavity 82 may be formed in circular cross section.

Figure 5:
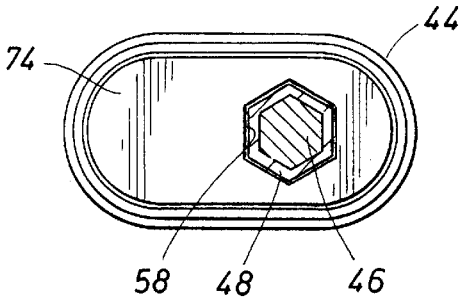
FIG. 5 is a top view of the bolt seal of the invention taken along view lines 5—5 of FIG. 3.

FIG. 3 includes section symbols 5—5, 6—6, 7—7, and 8—8, corresponding to FIGS. 5, 6, 7, and 8, respectively. As shown in FIG. 5, the cap 74 covers the top of the housing 44, to seal the housing and form a portion thereof. The bolt, comprising the bolt body 46 and sleeve 48, penetrates the passage 58, which extends through te cap. The bolt body and sleeve are preferably hexagonal, but any appropriate polygonal shape will do, so long as a flat side of the sleeve provides adequate surface area for the roller to ride upon.

Figure 7:
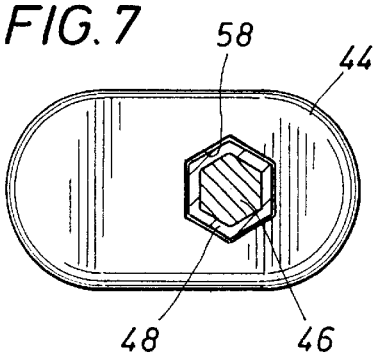
FIG. 7 is a bottom view of the bolt seal of the invention taken along view lines 7—7 of FIG. 3.
Figure 8:
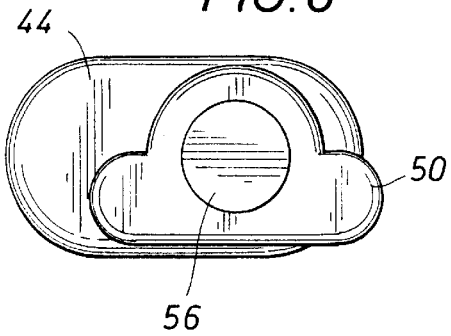
FIG. 8 is a bottom view of the bolt seal of the invention taken along view lines 8—8 of FIG. 3.

FIG. 6 provides a section view through the roller 64. The hook 68 extends into the roller, which is positioned between the ramp liner 62 and the sleeve 48. FIG. 7 shows the bolt body and sleeve extending through the passage 58 in the housing. FIG. 8 shows the bolt head 50 which is fixedly joined to the head 58 extending below the housing. The head 56 is preferably made as an integral part of the bolt body 46 and is thus made of steel, and the bolt head 50 is preferably formed of zinc. Note that in each of FIGS. 5–8, the housing 44 is shown having a racetrack sectional configuration, but any appropriate sectional configuration will suffice.

Operation of the Invention

Figure 9:
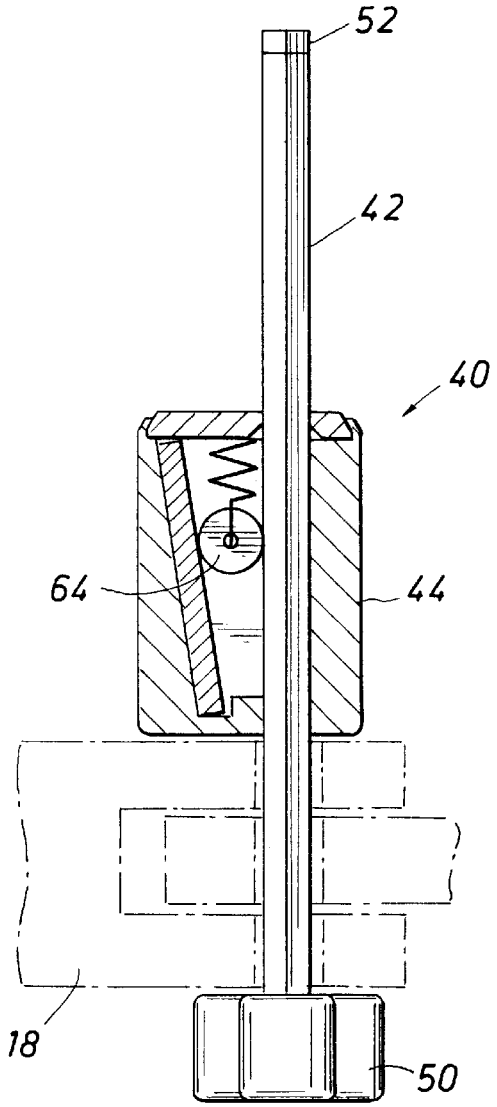
FIG. 9 is a side section view of the bolt seal of the invention, illustrating the bolt head snug against the hasp which it is locking.

FIGS. 9 through 12 inclusive illustrate the steps of the operation of the invention. FIG. 9 shows the lock 40 installed on a typical container door hasp 18 or the like. The bolt head 50 is positioned snug against one side of the hasp 18, and the housing 44 is positioned snug against the opposite side of the hasp. Thus, there is no space between the bolt head and the hasp for the insertion of the jimmying tool, which otherwise could be inserted through the hasp along the bolt and up into the housing, thereby forcing the roller up and out of contact with the bolt, thereby permitting the bolt to be slipped from the housing.

Figure 10:
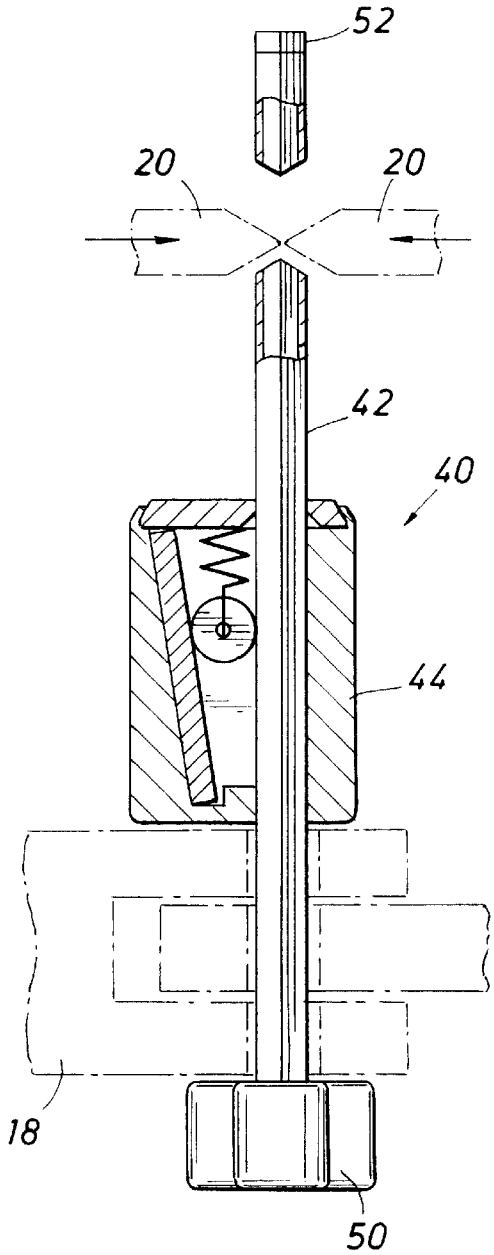
FIG. 10 is a side section view of the bolt seal of the invention, illustrating the first step in removing the bolt seal.
Figure 11:
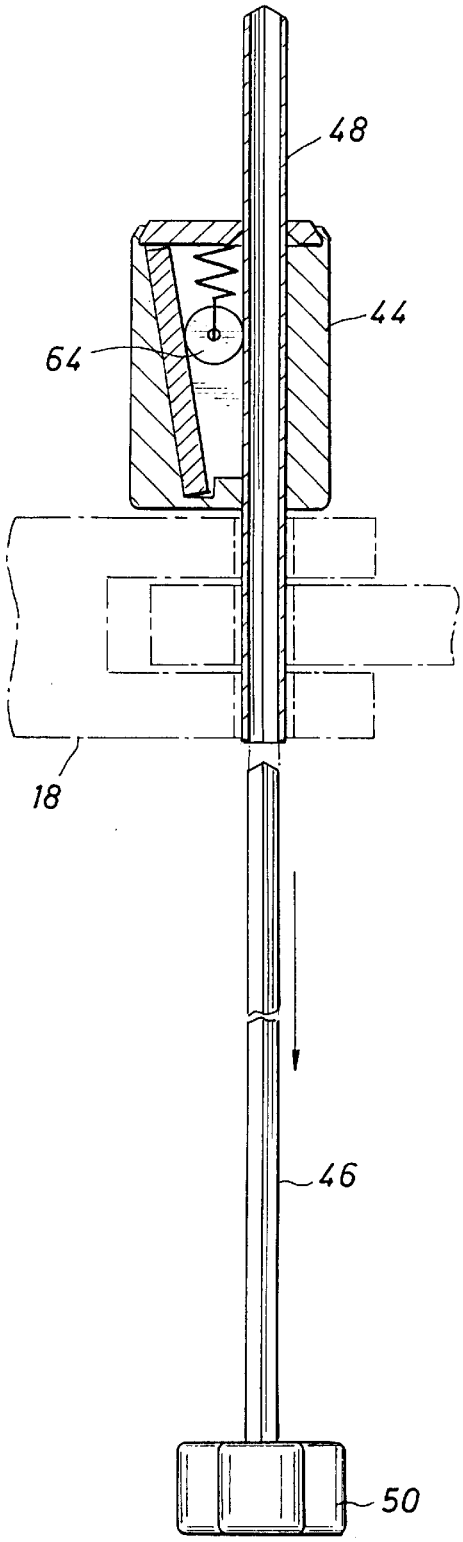
FIG. 11 is a side section view of the bolt seal of the invention, illustrating the second step in removing the bolt seal with the bolt being removed and the bolt sleeve still in place.
Figure 12:
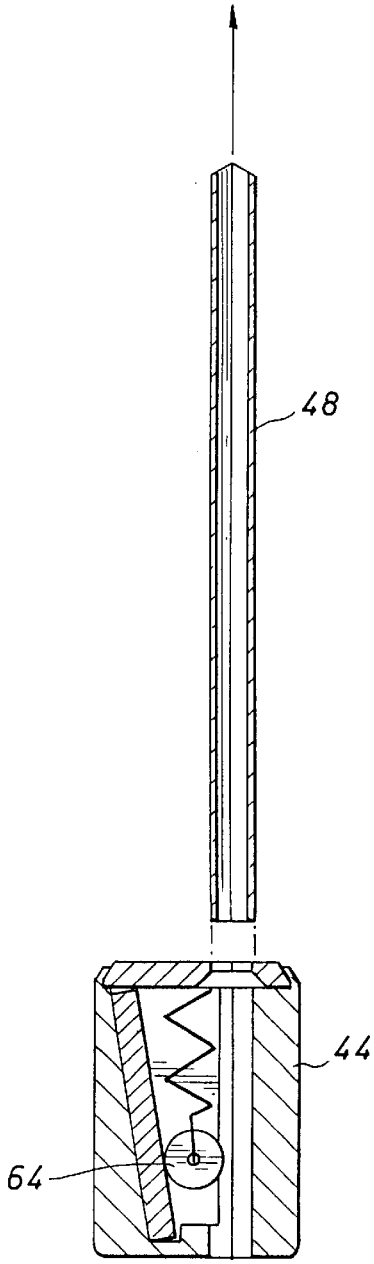
FIG. 12 is a side section view showing the step of removing the bolt sleeve.

When it is time to open the lock 40, the bolt 42 may be severed with a bolt cutter anywhere above the housing 44 and below the widened head 52 of the bolt, as shown in FIG. 10. Then, as shown in FIG. 11, the bolt body 46 slides out of the sleeve 48 since the widened head of the bolt has been removed. The sleeve and housing combination is then removed from the hasp 18, and the sleeve is removed from the housing 44, as shown in FIG. 11. The bolt body and sleeve are then discarded, since they are cheap, expendable items and have been severed, but the more expensive housing and internal mechanism can be reused.

Structure of Another Preferred Embodiment of the Invention

Figure 13:
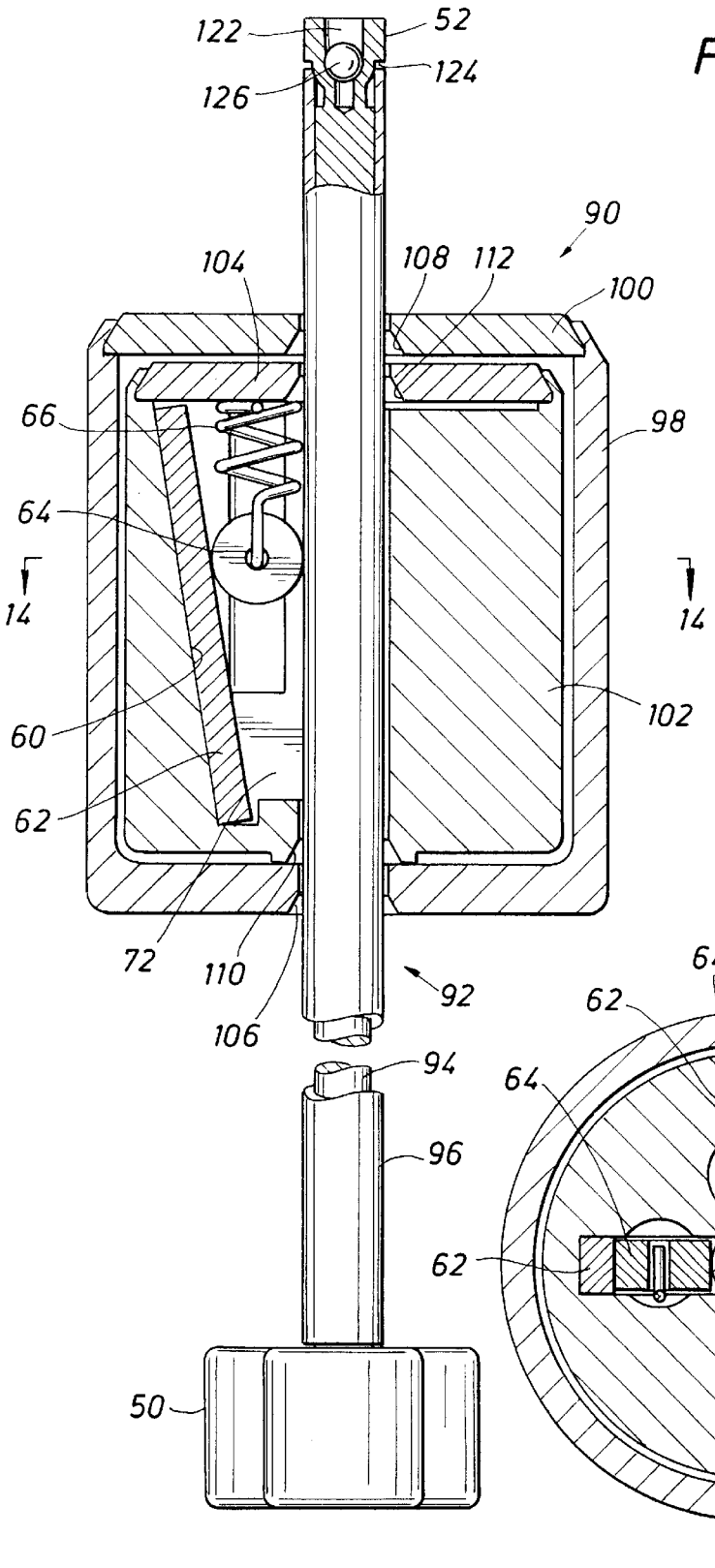
FIG. 13 is a side section view of an alternative preferred embodiment of the bolt lock of the present invention.
Figure 14:
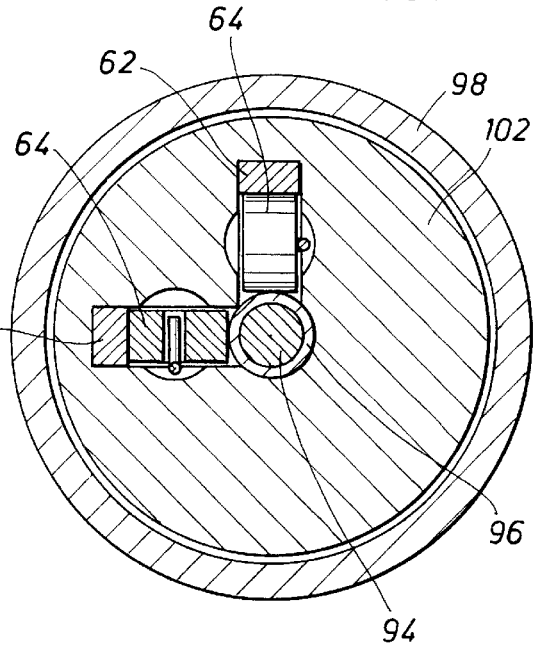
FIG. 14 is a top section view of the alternative preferred embodiment taken along section lines 14—14 of FIG. 13.

FIGS. 13 and 14 depict an alternative design of a bolt lock 90 of the invention. The bolt lock 90 includes a bolt 92 comprising a bolt body 94 and a sleeve 96, in this embodiment of circular cross section. These components can thus be made of less expensive stock material than the embodiment of FIGS. 3–12. The bolt body 94 is fixedly joined to the bolt head 50 as previously described. The bolt lock 90 further comprises a housing 98 sealed with a housing cover 100. Inside the housing 98 is a freely rotatable lock body 102, and the housing 98 and lock body 102 are also preferably circular in cross section, as shown in FIG. 14. The lock body 102 is provided with a pair of slots 72, identical in all respects to the slot 72 of FIG. 3. The slots 72 are covered over with a lock body cap 104, which also retains a pair of springs 66. The housing 98 includes a conical opening 106 at the bottom and a conical opening 108 at the top. Similarly, the lock body 102 includes a conical opening 110 at the bottom, and the lock body cap 104 includes a conical opening 112. The conical openings are provided for the ease of insertion of the bolt 92.

As previously described, the lock body 102 freely rotates with the housing 98. This prevents the rotation of the bolt relative to the lock body, which may serve to defeat the seal lock. This design finds inspiration in my U.S. Pat. No. 6,155,617. The dual roller design enhances the load carrying capability of the lock, thus making the design more resistant to being forced, as by a crow bar. The materials of construction and the mode of opening the lock as the same as previously described.

Returning briefly to FIG. 3, as previously described, the bolt body 42 includes an enlarged bolt head 52. In the embodiment of FIG. 3, the enlarged bolt head 52 is preferably made by machining a cylindrical groove 120 into the bolt body, which is made of a polygonal stock material of uniform diameter. A hole 122 is drilled or otherwise formed in the end of the bolt body, and an enlarging tool (not shown) is forced down into the hole 122. This enlarges the diameter of the bolt body, thus forming the enlarged bolt head 52, and further develops a shoulder 124 for abutting contact with the sleeve 48. The enlarging tool is then removed.

In the embodiment of FIG. 13, the enlarged head 52 is formed in a slightly different way. In this case, a steel ball 126 is jammed down into the hole 122 and left there, thus forming the enlarged bolt head 52 and the shoulder 124. The techniques for forming the enlarged bolt head 52 were developed because in assembling the bolt body and sleeve combination, the sleeve is slid around the bolt body down to abutting contact at the abutment 54, and then the enlarged head 52 is formed to hold the sleeve in place on the bolt body.

It is worth noting that the enlarged head is formed because the outer sleeve is preferably aluminum and the bolt body is preferably steel, and these dissimilar metals are difficult to join together. If the outer sleeve and bolt body are made of materials which can be welded, soldered, or brazed together, then the enlarged head can be eliminated.

The principles, preferred embodiments, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A hasp sealing bolt seal comprising:

a. a bolt comprising an inner bolt body and an outer bolt sleeve, the sleeve slidably mounted on the bolt body and held stationary relative to the bolt body at a junction, the inner bolt body defining a bolt head;

b. a lock housing defining a channel therethrough and held in frictional contact with the sleeve, the bolt extending entirely through and beyond the lock housing, wherein the lock housing includes an internal ramp, and further comprising a spring loaded roller providing frictional contact between the ramp and the sleeve, and wherein the sleeve separates the roller from contact with the inner bolt body; and c. wherein the bolt head is positioned on a first side of the lock housing, and wherein the bolt defines a severing point on a second side of the lock housing opposite the bolt head for removal of the bolt seal.

2. The bolt seal of claim 1, wherein the bolt body and bolt sleeve are polygonal in cross section.

3. The bolt seal of claim 1, wherein the bolt body and bolt sleeve are hexagonal in cross section.

4. The bolt seal of claim 1, wherein the lock housing includes an internal ramp, and further comprising:

a. a ramp liner on the ramp; and b. a spring loaded roller providing frictional contact between the ramp liner and the sleeve.

5. The bolt seal of claim 4, wherein the roller is formed of a material at least as hard as the ramp liner.

6. The bolt seal of claim 5, wherein the roller is formed of a material that is harder than the bolt.

7. The bolt seal of claim 4, further comprising a spring to spring-load the roller.

8. The bolt seal of claim 7, further comprising a housing cap on the lock housing, and wherein the spring is retained by the housing cap.

9. The bolt seal of claim 1, wherein the enlarged portions at either end of the bolt body comprise a first enlargement at one end of the bolt body and a second enlargement at the other end of the bolt body.

10. The bolt seal of claim 9, wherein the first enlargement is formed as an integral part of the bolt body.

11. The bolt seal of claim 10, wherein the second enlargement comprises a bolt body head fixedly attached to the bolt body.

12. The bolt seal of claim 11, wherein the sleeve is in abutting contact with the first enlargement and the second enlargement.

13. The bolt seal of claim 1, wherein the bolt body and bolt sleeve are circular in cross section.

14. The bolt seal of claim 1, wherein the lock housing comprises:

a. an outer cylindrical enclosure; and b. an internal lock body, wherein the internal lock body is rotatable relative to the enclosure.

15. The bolt seal of claim 14, further comprising a pair of spring loaded rollers providing frictional contact between the internal lock body and the sleeve.

16. The bolt seal of claim 15, further comprising a pair of ramps in the internal lock body, and wherein the rollers ride on the ramps.

17. The bolt seal of claim 16, further comprising a ramp liner on each of the pair of ramps, and wherein each of the pair of rollers rides on its respective ramp liner.

18. A method of unsealing a bolt seal from a hasp, the bolt seal comprising a bolt having an inner bolt body and an outer bolt sleeve, the sleeve slidably mounted on the bolt body and held stationary relative to the bolt body at a junction, the inner bolt body defining a bolt head, the bolt seal further comprising a lock housing defining a channel therethrough and held in frictional contact with the sleeve, the bolt extending entirely through and beyond the lack housing, wherein the lock housing includes an internal ramp, and further comprising a spring loaded roller providing frictional contact between the ramp and the sleeve, and wherein the sleeve separates the roller away from contact with the bolt, wherein the bolt head is positioned on a first side of the lock housing, and wherein the bolt defines a severing point on a second side of the lock housing opposite the bolt head for removal of the bolt seal, the method comprising the steps of:

a. severing the inner bolt body and the sleeve at the severing point;

b. sliding the bolt out of the sleeve in a first direction; and c. sliding the sleeve out of the housing in a second direction.

19. A bolt seal for sealing a hasp comprising:

a. a bolt comprising an inner bolt body and an outer bolt sleeve, the sleeve slidably mounted on the bolt body and held stationary relative to the bolt body at a junction, the bolt body defining a bolt head, the sleeve defining an elongate outer surface;

b. a lock housing held in frictional contact with the sleeve, wherein the lock housing includes an internal ramp, and further comprising a spring loaded cylindrical roller providing frictional contact along a line of contact between the ramp and the sleeve, and wherein the roller contacts the sleeve but not the inner bolt body;

c. a channel through the locking housing adapted to conform to the elongate outer surface of the sleeve, the bolt extending entirely through and beyond the lock housing; and d. wherein the bolt head is positioned on a first side of the lock housing, and wherein the bolt defines a severing point on a second side of the lock housing opposite the bolt head for removal of the bolt seal.

20. The bolt seal of claim 19, wherein the elongate outer surface of the sleeve defines a polygonal cross section, and wherein the channel further defines a polygonal interior surface to conform to the cross section of the sleeve.

21. A bolt seal adapted to be inserted through a hasp to be sealed, and further adapted to be removed from the hasp to be sealed, the hasp to be sealed defining a first side and a second side, the bolt seal comprising:

an elongated inner bolt body having a bolt head, wherein the bolt head fits in abutting contact with the first side of the hasp to be sealed;

a sleeve around the inner bolt body;

a friction lock mount, adapted for abutting contact with the second side of the hasp to be sealed, wherein the inner bolt body and sleeve extend through and beyond the friction lock mount and further wherein the bolt seal is removed from the hasp to be sealed by severing the inner bolt body and the sleeve at a point where the bolt body and sleeve extend beyond the friction lock mount on a side of the lock mount opposite the bolt head.

* * * * *

UNITED STATES PATENT AND TRADEMARK OFFICE

CERTIFICATE OF CORRECTION

PATENT NO. : 6,550,830 B2
DATED : April 22, 2003
INVENTOR(S) : Rainer Kuenzel

It is certified that error appears in the above-identified patent and that said Letters Patent is hereby corrected as shown below:

Title page,
Item [76], Inventors, the name of the inventor should read -- Rainer Kuenzel --

Signed and Sealed this

Third Day of February, 2004

JON W. DUDAS
*Acting Director of the United States Patent and Trademark Office*